US008492981B2

(12) United States Patent
Shin et al.

(10) Patent No.: US 8,492,981 B2
(45) Date of Patent: Jul. 23, 2013

(54) LIGHTING APPARATUS USING PN JUNCTION LIGHT-EMITTING ELEMENT

(75) Inventors: Sang Hyun Shin, Gyeonggi-do (KR); Seon Ho Kim, Gyeonggi-do (KR)

(73) Assignee: Wooree Lighting Co., Ltd., Gyeonggi-Do (KR)

( * ) Notice: Subject to any disclaimer, the term of this patent is extended or adjusted under 35 U.S.C. 154(b) by 260 days.

(21) Appl. No.: 13/081,625

(22) Filed: Apr. 7, 2011

(65) Prior Publication Data

US 2012/0217891 A1 Aug. 30, 2012

(30) Foreign Application Priority Data

Feb. 25, 2011 (KR) ..... 10-2011-0016997

(51) Int. Cl.
*H05B 37/00* (2006.01)
*H05B 39/00* (2006.01)
*H05B 41/00* (2006.01)

(52) U.S. Cl.
USPC ..... 315/185 R; 315/192; 315/193

(58) Field of Classification Search
None
See application file for complete search history.

(56) References Cited

U.S. PATENT DOCUMENTS

| | | | | |
|---|---|---|---|---|
| 5,663,719 | A * | 9/1997 | Deese et al. | 340/912 |
| 6,942,361 | B1 * | 9/2005 | Kishimura et al. | 362/240 |
| 7,764,028 | B2 | 7/2010 | Mariyama et al. | |
| 7,891,853 | B2 | 2/2011 | Park | |
| 2011/0031889 | A1 | 2/2011 | Shim | |
| 2011/0210346 | A1 * | 9/2011 | Chen et al. | 257/88 |

FOREIGN PATENT DOCUMENTS

| | | |
|---|---|---|
| JP | 2008-218043 | 9/2008 |
| KR | 100926040 | 11/2009 |
| KR | 10-2009-0127208 | 12/2009 |
| KR | 10-2010-0009201 | 1/2010 |
| KR | 1020100052629 | 5/2010 |
| KR | 10-2010-0121816 | 11/2010 |

OTHER PUBLICATIONS

PCT International Search Report dated Jun. 29, 2012 from PCT Application No. PCT/KR2011/00008363 filed Apr. 11, 2011 which claims the same priority as the instant application; 2 pgs.
English Summary of a Korean Patent Office Action for the priority Korean Patent Application No. 10-2011-0016997 dated May 5, 2012; 7 pgs.

* cited by examiner

*Primary Examiner* — Anh Tran
(74) *Attorney, Agent, or Firm* — Harness, Dickey & Pierce, P.L.C.

(57) ABSTRACT

The present disclosure discloses a lighting apparatus using a PN junction light-emitting element, the apparatus including: a power transmitting substrate having a plurality of boundaries defined thereon; a plurality of PN junction light-emitting elements positioned within each boundary and divided into a plurality of groups; and a first switch provided on the power transmitting substrate, wherein the first switch goes into the ON state by a supplied AC having a first voltage to cause PN junction light-emitting elements of a first group positioned within each boundary to emit light, and the first switch is in the OFF state when PN junction light-emitting elements of a second group, which is positioned within each boundary and connected in series to the first group, emit light by a supplied AC having a second voltage higher than the first voltage.

10 Claims, 7 Drawing Sheets

LIGHTING APPARATUS USING PN JUNCTION LIGHT-EMITTING ELEMENT

CROSS-REFERENCE TO RELATED APPLICATIONS

This application claims the benefit and priority of Korean patent Application No. KR-10-2011-0016997, filed Feb. 25, 2011. The entire disclosure of the above application is incorporated herein by reference.

FIELD

The present disclosure, in general, relates to a lighting apparatus using a PN junction light-emitting element, and more particularly, to a lighting apparatus using a PN junction light-emitting element that has reduced volume and weight.

BACKGROUND

This section provides background information related to the present disclosure which is not necessarily prior art.

In a lighting apparatus using a PN junction light-emitting element, a light-emitting diode (LED) module having a plurality of LEDs mounted on a power transmitting substrate is typically used as a light source. The LEDs have the advantages of small size, low power consumption and excellent control characteristics, and therefore the LED lighting apparatus can be made slim and lightweight. However, a typical LED lighting apparatus includes a heat sink for heat dissipation or a separate drive circuit for driving an LED module. Elements such as the heat sink or the drive circuit make it difficult to realize a slim and lightweight design of the LED lighting apparatus.

For example, the drive circuit may include an A/D converter to supply DC power, and the A/D converter includes a trans-coil for lowering the voltage of AC. The trans-coil has a drawback in that, since the trans-coil is arranged occupying a large space in the drive circuit, the dimension of the product having the same becomes large.

In order to solve the problems as described above, a power supply device called a switching mode power supply (SMPS) has been recently employed. Here, the SMPS transforms an AC frequency (50 Hz-60 Hz) into a DC frequency, so it requires a high level of technologies.

However, it is necessary for a conventional LED driver using an SMPS to have a noise filter because it uses high-speed switching and hence generates much noise. Besides, it is difficult to configure a circuit at a low cost because a lot of parts are used for circuit configuration. Additionally, the SMPS itself occupies a fairly large size compared to the size of an LED module. As a result, there are limitations on the miniaturization of the LED module and thus of the product itself.

Meanwhile, since the LED module includes a plurality of LEDs, the overall current capacity becomes large. Thus, the conventional LED drive circuit employs an electrolytic capacitor as a part. Such an electrolytic capacitor is suitable for a circuit with high capacitance, but its poor frequency characteristics and relatively high aging degradation reduce the reliability of the circuit. Particularly, in the case of an electrolytic capacitor being mounted, together with an LED, on a power transmitting substrate, the lifespan of the electrolytic capacitor is much shortened due to heat generated by light emission of the LED. Moreover, as the volume of an inductor and a capacitor increases in a circuit having a plurality of LEDs arranged thereon, this may even cause limitations to the exterior design of an LED lighting apparatus.

In addition, as an example of the conventional lighting apparatus, disclosed is a lighting apparatus in which a plurality of PN junction light-emitting elements are arranged in both directions, with their rows being connected in parallel, and used directly for an AC power source without using a separate drive circuit. Voltage is adjusted as needed via a resistor. The PN junction light-emitting elements in one direction emit light when a positive (+) voltage is applied thereto, and the PN junction light-emitting elements in the opposite direction emit light when a negative (−) voltage is applied thereto.

Such a lighting apparatus is advantageous in that a lighting apparatus using a PN junction light-emitting element can be easily implemented without using a separate drive circuit for converting AC into DC, but poses a problem in the use of a dimmer (see FIG. 2). For instance, if light is dimmed to 5V when 10V is required to drive the PN junction light-emitting elements connected in series, no current conduction occurs. If a dimmer adapted to set the conduction time by on/off is used, the PN junction light-emitting elements basically emit no light at 10V or less so that their emission time is limited. In addition, the conduction time limitation imposed by the dimmer may cause problems such as flickering.

SUMMARY

This section provides a general summary of the disclosure and is not a comprehensive disclosure of its full scope or all of its features.

According to one aspect of the present disclosure, there is provided a lighting apparatus using a PN junction light-emitting element, the apparatus including: a power transmitting substrate having a plurality of boundaries defined on the power transmitting substrate; a plurality of PN junction light-emitting elements positioned within each boundary and divided into a plurality of groups; and a first switch that is provided on the power transmitting substrate, wherein the first switch goes into the ON state by a supplied AC having a first voltage to cause PN junction light-emitting elements of a first group positioned within each boundary to emit light, and the first switch is in the OFF state when PN junction light-emitting elements of a second group, which is positioned within each boundary and connected in series to the first group, emit light by a supplied AC having a second voltage higher than the first voltage.

According to another aspect of the present disclosure, there is provided a lighting apparatus using a PN junction light-emitting element, the apparatus including: a first light-emitting module including a first power transmitting substrate and a plurality of PN junction light-emitting elements provided on the first power transmitting substrate; a second light-emitting module including a second power transmitting substrate electrically connected to the first power transmitting substrate and a plurality of PN junction light-emitting elements provided on the second power transmitting substrate; and a first switch that goes into the ON state by a supplied AC having a first voltage to cause the PN junction light-emitting elements of the first groups positioned on the first power transmitting substrate and the second power transmitting substrate to emit light, and is in the OFF state when the PN junction light-emitting elements of the second groups, which are positioned on the first power transmitting substrate and the second power transmitting substrate and connected in series to the first groups, emit light by a supplied AC having a second voltage higher than the first voltage.

Further areas of applicability will become apparent from the description provided herein. The description and specific examples in this summary are intended for purposes of illustration only and are not intended to limit the scope of the present disclosure.

DESCRIPTION OF DRAWINGS

The drawings described herein are for illustrative purposes only of selected embodiments and not all possible implementations, and are not intended to limit the scope of the present disclosure.

DETAILED DESCRIPTION

The present disclosure will now be described in detail with reference to the accompanying drawings.

Figure 1:
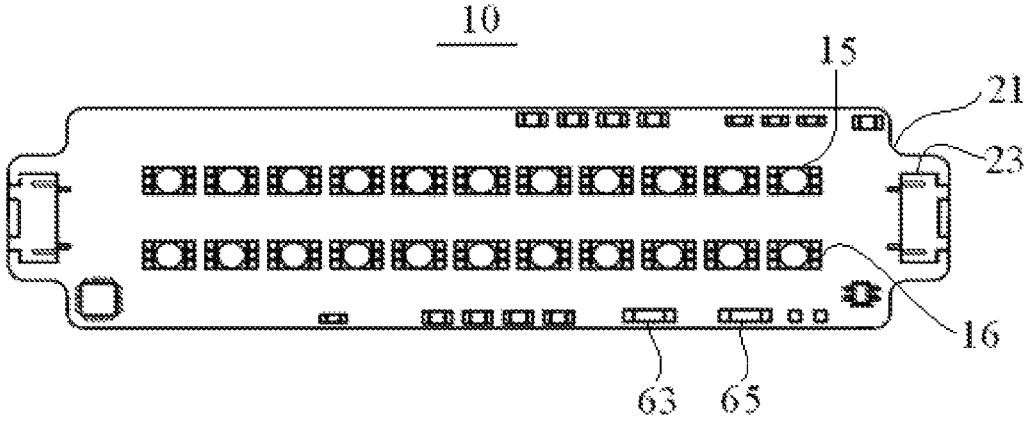
FIG. 1 is a view showing an example of a lighting apparatus using a PN junction light-emitting element according to the present disclosure.
Figure 2:
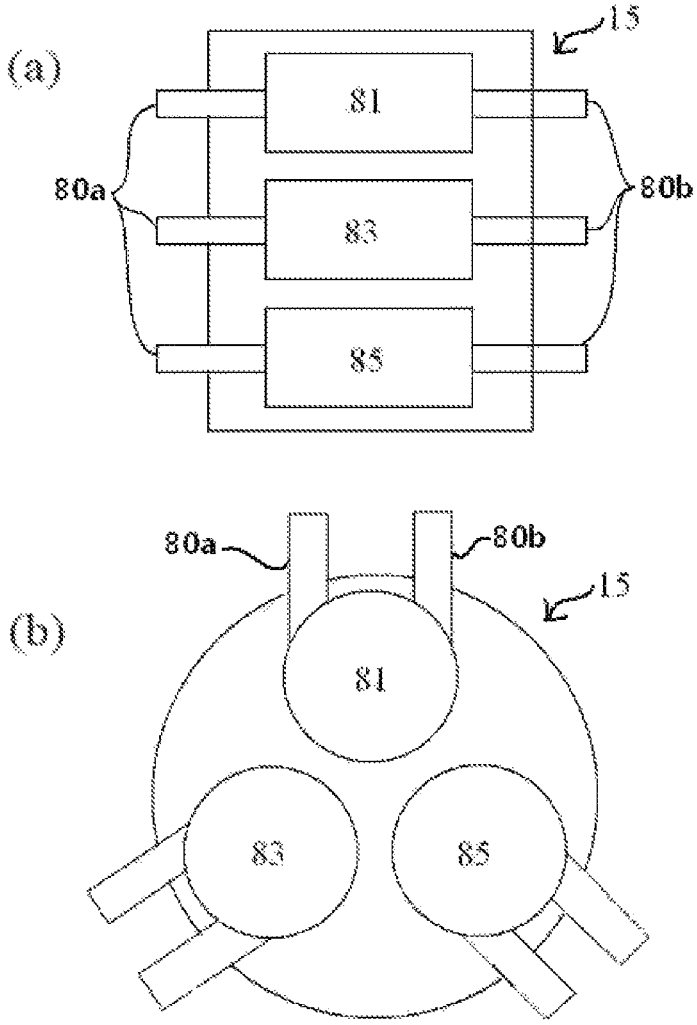
FIG. 2 is a view showing examples of a light-emitting element package shown in FIG. 1.
Figure 3:
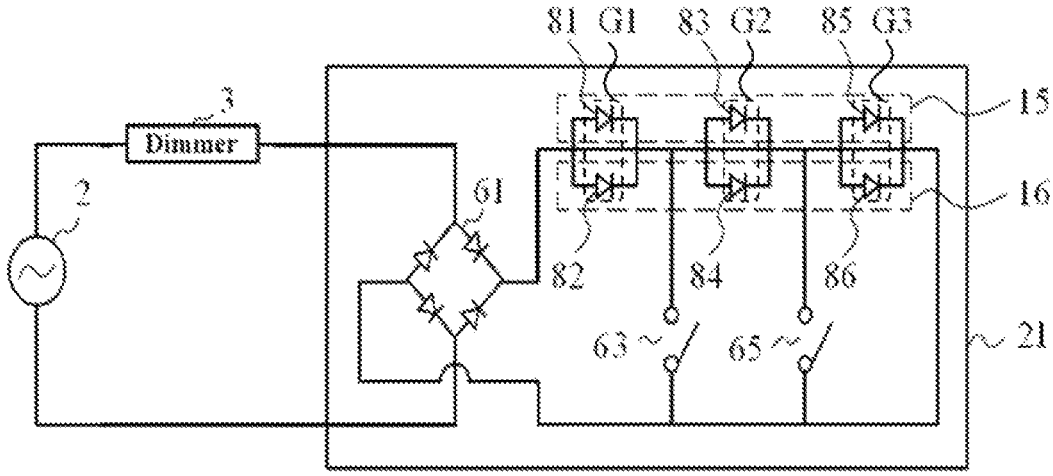
FIG. 3 is a view showing an example of electrical connections of the lighting apparatus using the PN junction light-emitting element according to the present disclosure.

FIG. 1 is a view showing an example of a lighting apparatus using a PN junction light-emitting element according to the present disclosure. FIG. 2 is a view showing examples of a light-emitting element package shown in FIG. 1. FIG. 3 is a view showing an example of electrical connections of the lighting apparatus using the PN junction light-emitting element according to the present disclosure.

The lighting apparatus 10 using the PN junction light-emitting element includes a power transmitting substrate 21, a plurality of PN junction light-emitting elements 81, 82, 83, 84, 85 and 86, a first switch 63, a second switch 65, a rectifying circuit 61 including a bridge diode, and a dimmer 3.

The power transmitting substrate 21 is, for example, a printed circuit board. The power transmitting substrate 21 may include a metal layer for heat dissipation, a wiring layer, and a connector 23. The wiring layer is formed on the metal layer and may include wiring and an insulating layer for insulating the wiring. The power transmitting substrate 21 may have various shapes, including a disc, a rectangular plate, a linear rod, etc. according to applications of the lighting apparatus 10 using the PN junction light-emitting element.

As shown in FIG. 1, the connector 23 may be provided on each of the opposite short-side peripheries of the power transmitting substrate 21 of an approximately rectangular shape and receives power from an external source. A connection cable 40 (see FIG. 5) is coupled to the connector 23 to apply transmitted power to the connector 23. A plurality of lighting apparatuses 10 using a PN junction light-emitting element may be electrically connected to each other via the connection cable 40.

As shown in FIG. 3, the PN junction light-emitting elements 81, 82, 83, 84, 85 and 86 are mounted on the power transmitting substrate 21 and emit light by supplied power. A typical example of the PN junction light-emitting element is a light-emitting diode (LED), and another example thereof may include a laser diode (LD). A plurality of boundaries are defined on the power transmitting substrate 21.

A boundary is a unit in which the plurality of PN junction light-emitting elements 81, 82, 83, 84, 85 and 86 are arranged. For example, the boundaries in FIGS. 1 and 2 are light-emitting element packages 15 and 16 having a plurality of PN junction light-emitting elements 81, 82, 83, 84, 85 and 86 incorporated thereon. The number and arrangement of light-emitting element packages 15 and 16 may vary according to the type and use of the lighting apparatus 10 using the PN junction light-emitting element, and FIG. 1 illustrates the arrangement of the light-emitting element packages 15 and 16 in two rows. FIG. 3 shows an electrical connection between the first light-emitting element package 15 and the second light-emitting element package 16 and the power transmitting substrate 21 as a representative example of the light-emitting element packages 15 and 16 of the first and second rows.

The plurality of PN junction light-emitting elements 81, 82, 83, 84, 85 and 86 positioned within each boundary, i.e., each light-emitting element package 15 or 16 are divided into a plurality of groups. The number of groups may vary depending on the number of PN junction light-emitting elements included in one boundary. For example, as shown in FIGS. 1, 2 and 3, a PN junction light-emitting element 81 of the first group G1, a PN junction light-emitting element 83 of the second group G2, and a PN junction light-emitting element 85 of the third group G3 are positioned within the first light-emitting element package 15. A PN junction light-emitting element 82 of the first group G1, a PN junction light-emitting element 84 of the second group G2, and a PN junction light-emitting element 86 of the third group G3 are positioned within the second light-emitting element package 16. As shown in FIG. 2, an input lead line 80*a* and an output lead line 80*b* are individually connected to the three PN junction light-emitting elements 81, 82, 83, 84, 85 and 86 positioned within each of the first and second light-emitting element packages 15 and 16.

As shown in FIG. 3, the first group G1, the second group G2 and the third group G3 are connected in series. The PN junction light-emitting elements of the same group may be connected in parallel or in series. FIG. 3 illustrates a parallel connection thereof.

The first switch 63 is connected between the first group G1 and the second group G2, and the second switch 65 is connected between the second group G2 and the third group G3. The first switch 63 goes into the ON state by a supplied AC having a first voltage to cause the PN junction light-emitting elements 81 and 82 of the first group G1 positioned within the first and second light-emitting element packages 15 and 16 to emit light, and is in the OFF state when the PN junction light-emitting elements 83 and 84 of the second group G2 emit light by a supplied AC having a second voltage higher than the first voltage.

The second switch 65 goes into the ON state when the first switch 63 is in the OFF state by the supplied AC having the second voltage, thereby causing the PN junction light-emitting elements 83 and 84 of the second group G2 to emit light.

In order to drive the PN junction light-emitting elements using AC, the PN junction light-emitting elements connected in series may be arranged in both directions so that the PN junction light-emitting elements arranged in different directions are alternately driven depending on a directional change in current. On the contrary, as shown in FIG. 3, the PN junction light-emitting elements 81, 82, 83, 84, 85 and 86 may be arranged in one direction, and the rectifying circuit 61 may be used to supply current in one direction to the PN junction light-emitting elements 81, 82, 83, 84, 85 and 86.

FIGS. 4*a-c* are views for explaining changes of the AC voltage caused by the application of a dimmer.

The dimmer 3 may adjust the brightness of the lighting apparatus 10 using the PN junction light-emitting element by adjusting the AC voltage.

As shown in FIG. 4*a*, when the AC voltage reaches V1, the PN junction light-emitting elements 81 and 82 of the first group G1 can emit light. At this point, if the first switch 63 is in the ON state, this causes AC to flow, thus enabling the first group G1 to emit light. Moreover, when the AC voltage reaches V2, the PN junction light-emitting elements 83 and 84 of the second group G2 can emit light. At this point, if the first switch 63 is in the OFF state and the second switch 65 is in the ON state, the first group G1 and the second group G2 can emit light. In addition, when the AC voltage reaches V3, the PN junction light-emitting elements 85 and 86 of the third group G3 can emit light. At this point, if the first switch 63 and the second switch 65 are in the OFF state, the first group G1, the second group G2 and the third group G3 can emit light.

As shown in FIG. 4*b*, when the maximum voltage is set to a value between V2 and V3 by the dimmer 3, light emission occurs only in the first group G1 and the second group G2 while no light emission occurs in the third group G3. In the present disclosure, the PN junction light-emitting element 81 of the first group G1, the PN junction light-emitting element 83 of the second group G2, and the PN junction light-emitting element 85 of the third group G3 are included in one boundary, for example, the first light-emitting element package 15, while the PN junction light-emitting element 82 of the first group G1, the PN junction light-emitting element 84 of the second group G2, and the PN junction light-emitting element 86 of the third group G3 are included in another boundary, i.e., the second light-emitting element package 16. Thus, light emission occurs in both of the first light-emitting element package 15 and the second light-emitting element package 16 positioned throughout the lighting apparatus 10 even if the third group G3 emits no light due to dimming. That is, when the maximum voltage is set to a value between V2 and V3 by the dimmer 3, it is rather dark because there is no section where all of the three PN junction light-emitting elements 81, 82, 83, 84, 85 and 86 within one boundary emit light. Nevertheless, light emission occurs dimmed over the entire lighting apparatus 10 using the PN junction light-emitting element.

As shown in FIG. 4*c*, if dimming is performed by adjusting the conduction time, light is emitted only during half of a period of the AC voltage, thus reducing the overall amount of light. Nevertheless, light emission occurs dimmed over the entire lighting apparatus.

Figure 5:
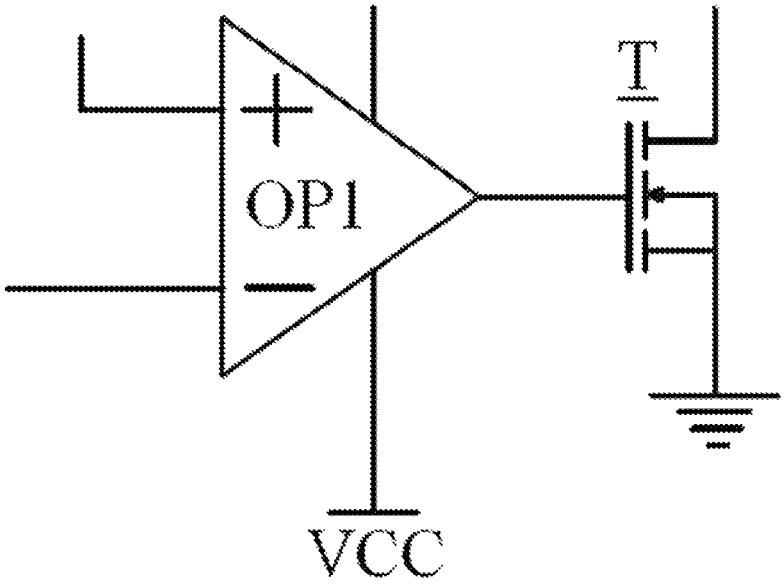
FIG. 5 is a view showing an example of the configuration of a switch shown in FIG. 3.

FIG. 5 is a view showing an example of the configuration of a switch shown in FIG. 3.

Figure 4:
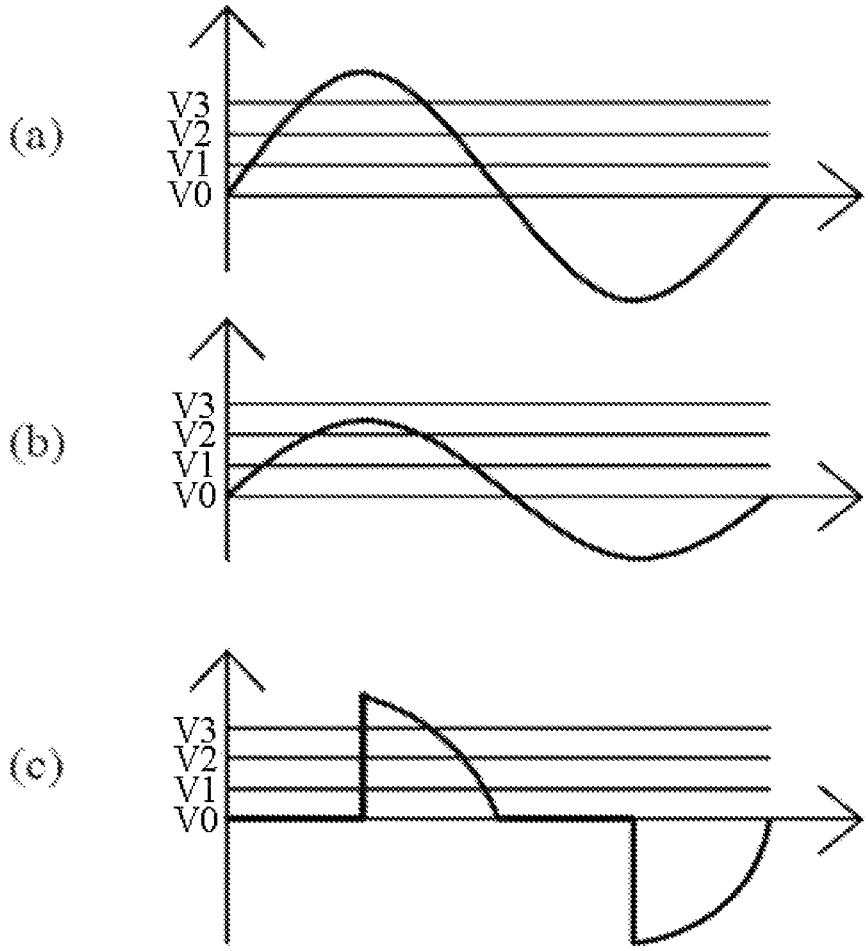
FIG. 4 is a view for explaining changes of the AC voltage caused by the application of a dimmer.

The switches 63 and 65 of FIG. 3 can be easily implemented by using an OP-amp comparator OP1 for sensing whether the magnitude of an AC voltage of a switching transistor T reaches V1, V2, and V3, respectively, as shown in FIG. 4.

Figure 6:
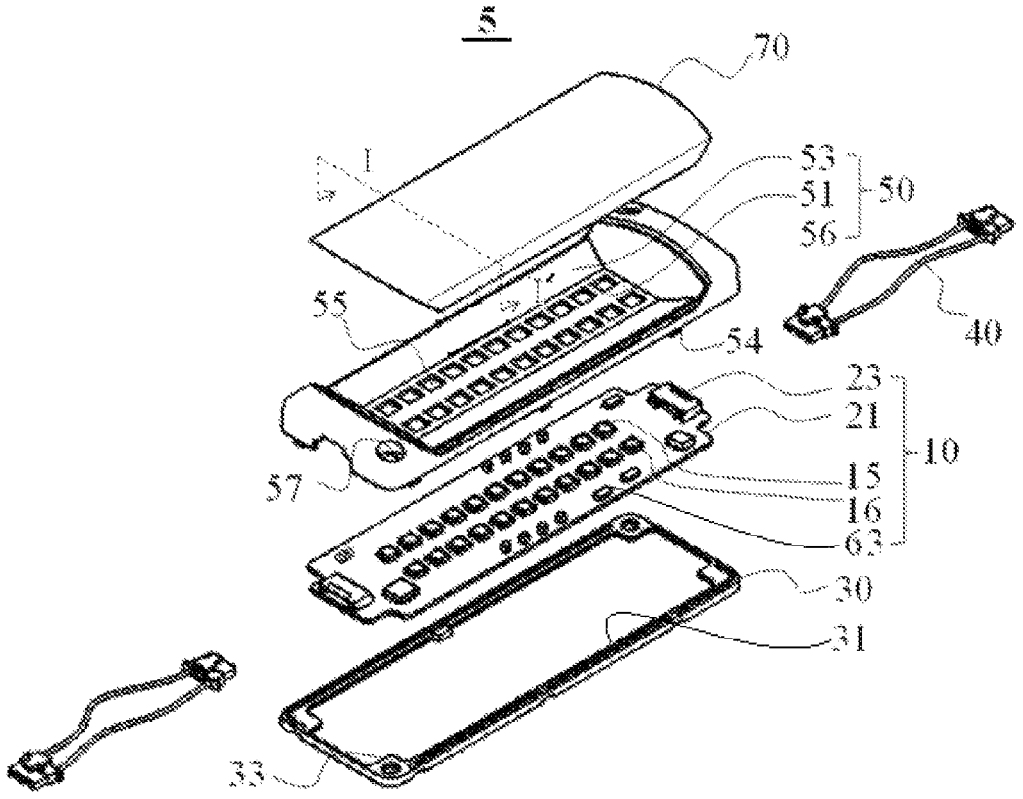
FIG. 6 is a view showing an application example of the lighting apparatus using the PN junction light-emitting element according to the present disclosure.
Figure 7:
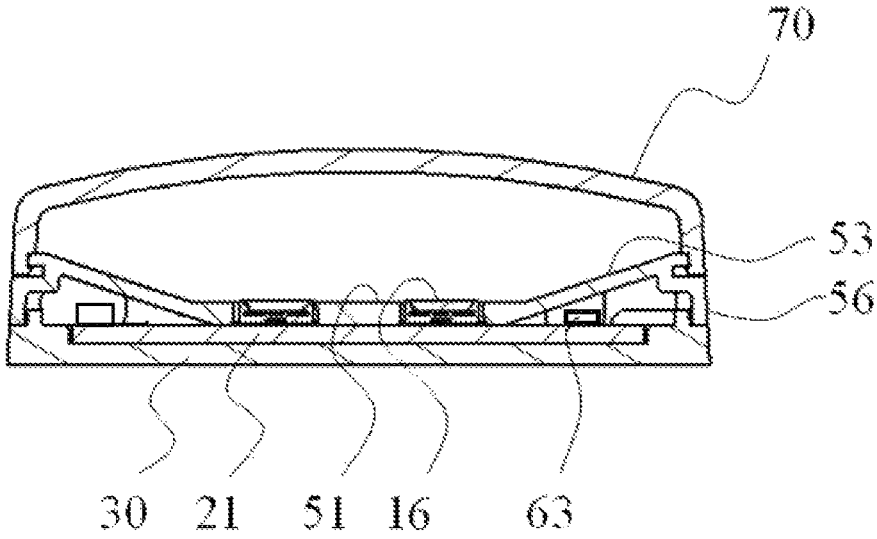
FIG. 7 is a sectional view taken along line I-I' shown in FIG. 6.

FIG. 6 is a view showing an application example of the lighting apparatus using the PN junction light-emitting element according to the present disclosure. FIG. 7 is a sectional view taken along line I-I' shown in FIG. 6.

As shown in FIGS. 6 and 7, the lighting apparatus 10 using the PN junction light-emitting element may be housed in a casing to thus configure a lighting module 5. The casing includes, for example, a bottom cover 30 and a top cover 50.

The lighting apparatus 10 using the PN junction light-emitting element is disposed on the bottom cover 30. The bottom cover 30 may be made of plastic, and, as shown in FIG. 6, the bottom cover 30 may have a slot 31 into which the power transmitting substrate 21 is to be inserted. Screw fastening holes 33 are formed at the corners of the bottom cover 30. The metal layer of the power transmitting substrate 21 is in contact with the bottom cover 30, and heat generated during the light emission of the PN junction light-emitting elements 15 is dissipated via the metal layer of the power transmitting substrate 21 and the bottom cover 30.

The lighting module 5 employing the lighting apparatus 10 using the PN junction light-emitting element has significantly reduced volume and weight because it has no heat sink having a heat dissipation fin or heat radiation blade. To improve the heat dissipation characteristics, the bottom cover 30 may be made of heat dissipation plastic having excellent heat dissipation characteristics. Moreover, an excessive temperature rise can be suppressed by decreasing the number of light-emitting element packages 15 and 16 mounted on the power transmitting substrate 21.

The top cover 50 is positioned over the power transmitting substrate 21 and coupled to the bottom cover 30. The top cover 50 may include, as shown in FIGS. 6 and 7, a base portion 51, a sloping portion 53, and a side portion 56.

Openings 55 corresponding to the light-emitting element packages 15 and 16 are formed in the base portion 51. The light-emitting element packages 15 and 16 may be exposed through the openings 55 and inserted into the openings 55 as shown in FIG. 7.

The sloping portion 53 extends from an edge of the base portion 51, and, as shown in FIG. 7, extends upward so as to form an angle of inclination with respect to the base portion 51. The sloping portion 53 corresponds to a periphery of the power transmitting substrate 21, and a space is defined between the power transmitting substrate 21 and the sloping portion 53 where the above-described first switch 63, second switch 65, rectifying circuit 61, and dimmer 3 are to be seated.

The side portion 56 extends downward from the upper end of the sloping portion 53 and is coupled to the bottom cover 30. For example, as shown in FIG. 6, a fastening protrusion 54 is provided on the side portion 56, and the bottom cover 30 may have a fastening hole into which the fastening protrusion 54 is inserted in a hook coupling manner. The top cover 50 may have a screw fastening hole 57 corresponding to the bottom cover 30.

A transparent lens 70 is positioned over the top cover 50 as shown in FIGS. 6 and 7, and a guide slot in which the transparent lens 70 is placed is formed in the upper end of the side portion 56 of the top cover 50. The transparent lens 70 shields and protects the light-emitting element packages 15 and 16 from the outside. The transparent lens 70 may be made of transparent plastic, and may transmit light coming from the PN junction light-emitting elements and adjust the orientation angle of the light.

As the lighting apparatus 10 using the PN junction light-emitting element is used for the lighting module as described above, there is no need to use a heat sink and a drive substrate for driving the light-emitting element packages 15 and 16, thus providing the slim and lightweight lighting module 5.

Figure 8:
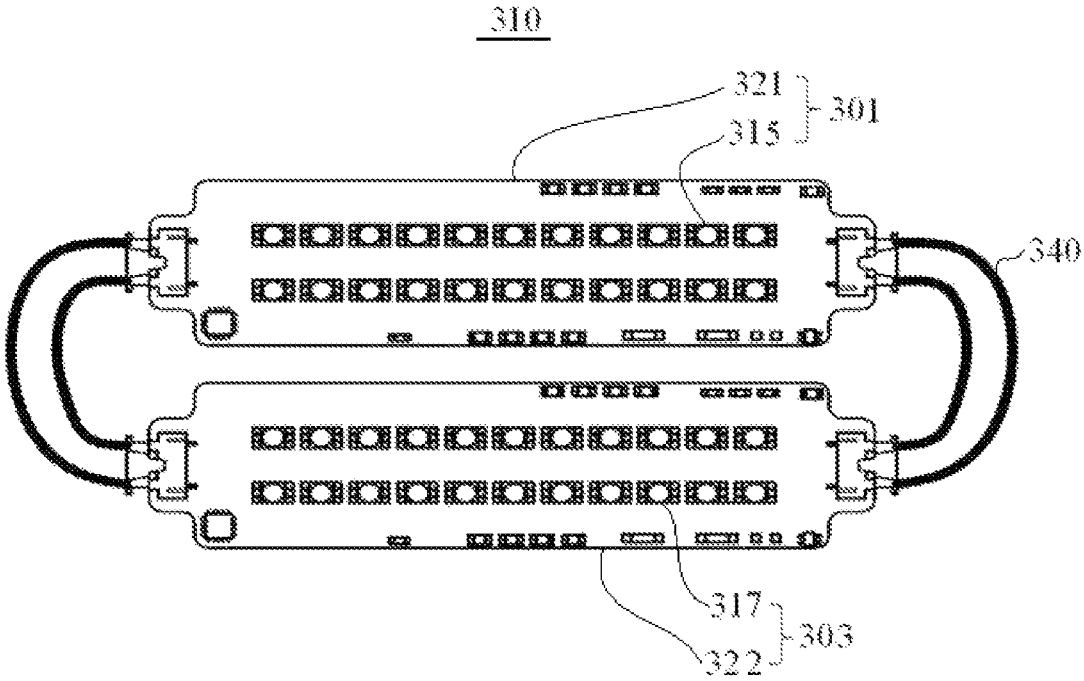
FIG. 8 is a view showing another example of the lighting apparatus using the PN junction light-emitting element according to the present disclosure.

FIG. 8 is a view showing another example of the lighting apparatus using the PN junction light-emitting element according to the present disclosure.

The lighting apparatus 310 using the PN junction light-emitting element shown in FIG. 8 is substantially identical to the lighting apparatus 10 using the PN junction light-emitting element explained with reference to FIGS. 1 to 7 except that a plurality of light-emitting modules 301 and 303 are electrically connected for circuit configuration. Accordingly, duplicate description thereof will be omitted.

A plurality of light-emitting element packages 315 are arranged on a first power transmitting substrate 321 to thus configure a first light-emitting module 301. A plurality of PN junction light-emitting elements are positioned within a light-emitting element package. The PN junction light-emitting elements within the light-emitting element package are divided into a plurality of groups. A plurality of light-emitting element packages 317 are arranged on a second power transmitting substrate 322 to thus configure a second light-emitting module 303.

A connection cable 340 is coupled to a connector to electrically connect the first power transmitting substrate 321 and the second power transmitting substrate 322. Accordingly, the PN junction light-emitting elements of the first group of the first light-emitting module 301 and the PN junction light-emitting elements of the first group of the second light-emitting module 303 may be connected in parallel. Also, the PN junction light-emitting elements of the second group of the first light-emitting module 301 and the PN junction light-emitting elements of the second group of the second light-emitting module 303 may be connected in parallel.

A first switch, a second switch and a rectifying circuit may be provided on either the first power transmitting substrate 321 or the second power transmitting substrate 322. The first switch goes into the ON state when a supplied AC has a first voltage and causes the PN junction light-emitting elements of the first groups positioned on the first power transmitting substrate 321 and the second power transmitting substrate 322 to emit light. When the first switch is in the OFF state by a supplied AC having a second voltage higher than the first voltage, the second switch goes into the ON state and causes the PN junction light-emitting elements of the second groups, which are positioned on the first power transmitting substrate 321 and the second power transmitting substrate 322 and connected in series to the first groups, to emit light.

In this manner, lighting apparatuses of various uses and types can be configured by connecting a plurality of light-emitting modules.

Hereinafter, various exemplary embodiments of the present disclosure will be described.

(1) A lighting apparatus using a PN junction light-emitting element, wherein a plurality of PN junction light-emitting elements within a boundary are packaged in a light-emitting element package, and the boundary is defined by the light-emitting element package.

(2) A lighting apparatus using a PN junction light-emitting element, wherein three PN junction light-emitting elements constitute one light-emitting element package, and an input lead line and output lead line are individually connected to each of the PN junction light-emitting elements.

(3) A lighting apparatus using a PN junction light-emitting element, wherein, in the first group, one PN junction light-emitting element positioned within the first boundary and one PN junction light-emitting element positioned within the second boundary are connected in parallel, and in the second group, another PN junction light-emitting element positioned within the first boundary and another PN junction light-emitting element positioned within the second boundary are connected in parallel.

Although PN junction light-emitting elements in a group may be connected either in series or in parallel, the lighting apparatus can more sensitively respond to dimming when they are connected in parallel. For instance, if three PN junction light-emitting elements (which emit light at 3V) are provided in a group, 3V is required for parallel connection while 9V is required for serial connection, and they can respond to the dimmer in units of 3V, not in units of 9V.

(4) A lighting apparatus using a PN junction light-emitting element, wherein the apparatus further includes a second switch that is provided on a power transmitting substrate and goes into the ON state to cause the PN junction light-emitting elements of the second group to emit light when the first switch is in the OFF state by a supplied AC having a second voltage.

This means that groups of PN junction light-emitting elements may be added as needed. For example, if only the PN junction light-emitting elements of the first group and the PN junction light-emitting elements of the second group are positioned within a boundary, the first switch alone may be connected between the first group and the second group.

(5) A lighting apparatus using a PN junction light-emitting element, wherein the PN junction light-emitting elements of the first group and the PN junction light-emitting elements of the second group that are positioned within one boundary are spaced apart from each other on the power transmitting substrate.

A boundary may be defined by one package having a plurality of chips, or by a plurality of chips provided on one substrate, or simply by disposing a plurality of chips or a package in one area. However, it is preferable to use one package to improve the degree of integration of the chips and in consideration of wiring to be required later.

In any method for defining a boundary, light can be emitted uniformly over the entire lighting apparatus according to changes in AC power despite the application of a dimmer by uniformly distributing the PN junction light-emitting elements of each group throughout the lighting apparatus.

(6) A lighting apparatus using a PN junction light-emitting element, wherein the apparatus further includes: a bottom cover positioned under the power transmitting substrate; a top cover positioned over the power transmitting substrate and having openings for exposing the PN junction light-emitting elements; and a transparent lens positioned over the top cover and transmitting light coming from the PN junction light-emitting elements.

This is a preferred embodiment of the lighting apparatus according to this disclosure. With this configuration, the lighting apparatus can emit light without any restrictions caused by a structural change of the first switch or the like accompanied by the use of the dimmer.

(7) A lighting apparatus using a PN junction light-emitting element, wherein the plurality of PN junction light-emitting elements positioned in a first light-emitting module and a second light-emitting module are packaged in light-emitting element packages, and the plurality of PN junction light-emitting elements positioned within each light-emitting element package are divided into a plurality of groups.

(8) A lighting apparatus using a PN junction light-emitting element, wherein the PN junction light-emitting elements of the first group of the first light-emitting module and the PN junction light-emitting elements of the first group of the second light-emitting module are connected in parallel, and the PN junction light-emitting elements of the second group of the first light-emitting module and the PN junction light-emitting elements of the second group of the second light-emitting module are connected in parallel.

In the lighting apparatus using the PN junction light-emitting element according to one aspect of the present disclosure, it is possible to reduce the volume and weight of a lamp employing the lighting apparatus using the PN junction light-emitting element because elements such as PN junction light-emitting elements, switches for driving the PN junction light-emitting elements, and so on are integrally provided on a power transmitting substrate such that no separate drive substrate is required.

Additionally, in the lighting apparatus using the PN junction light-emitting element according to another aspect of the present disclosure, the elements provided on the power transmitting substrate do not include an electrolytic capacitor having low resistance to heat, thereby preventing deterioration of reliability such as lifespan.

Moreover, in the lighting apparatus using the PN junction light-emitting element according to a further aspect of the present disclosure, it is possible to provide a lighting apparatus which is suitable to use AC with dimming.

Further, in the lighting apparatus using the PN junction light-emitting element according to a still further aspect of the present disclosure, it is possible to provide a slim and light-weight lighting apparatus using a PN junction light-emitting element because no heat sink is required and the bottom cover, the power transmitting substrate, the top cover, and the transparent lens have a compact coupling structure.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

What is claimed is:

1. A lighting apparatus using a PN junction light-emitting element, the apparatus comprising:

a power transmitting substrate having a plurality of boundaries defined thereon;

a plurality of PN junction light-emitting elements positioned within each boundary and divided into a plurality of groups; and a first switch provided on the power transmitting substrate, wherein the first switch goes into the ON state by a supplied AC having a first voltage to cause PN junction light-emitting elements of a first group positioned within each boundary to emit light, and the first switch is in the OFF state when PN junction light-emitting elements of a second group, which is positioned within each boundary and connected in series to the first group, emit light by a supplied AC having a second voltage higher than the first voltage, wherein the plurality of PN junction light-emitting elements within the boundary are packaged in a light-emitting element package, and the boundary is defined by the light-emitting element package.

2. The lighting apparatus of claim 1, wherein three PN junction light-emitting elements constitute one light-emitting element package, and an input lead line and output lead line are individually connected to each of the PN junction light-emitting elements.

3. The lighting apparatus of claim 1, wherein, in the first group, one PN junction light-emitting element positioned within the first boundary and one PN junction light-emitting element positioned within the second boundary are connected in parallel, and, in the second group, another PN junction light-emitting element positioned within the first boundary and another PN junction light-emitting element positioned within the second boundary are connected in parallel.

4. The lighting apparatus of claim 1, wherein the apparatus further comprises a second switch that is provided on the power transmitting substrate, and wherein the second switch goes into the ON state to cause the PN junction light-emitting elements of the second group to emit light when the first switch is in the OFF state by the supplied AC having the second voltage.

5. The lighting apparatus of claim 1, wherein the PN junction light-emitting elements of the first group and the PN junction light-emitting elements of the second group that are positioned within one boundary are spaced apart from each other on the power transmitting substrate.

6. The lighting apparatus of claim 1, wherein the apparatus further comprises:

a bottom cover positioned under the power transmitting substrate;

a top cover positioned over the power transmitting substrate and having openings for exposing the PN junction light-emitting elements; and a transparent lens positioned over the top cover and transmitting light coming from the PN junction light-emitting elements.

7. A lighting apparatus using a PN junction light-emitting element, the apparatus comprising:

a first light-emitting module including a first power transmitting substrate and a plurality of PN junction light-emitting elements provided on the first power transmitting substrate;

a second light-emitting module including a second power transmitting substrate electrically connected to the first power transmitting substrate and a plurality of PN junction light-emitting elements provided on the second power transmitting substrate; and a first switch that goes into the ON state by a supplied AC having a first voltage to cause PN junction light-emitting elements of a first group on the first power transmitting substrate and the second power transmitting substrate to emit light, and is in the OFF state when PN junction light-emitting elements of a second group which are positioned on the first power transmitting substrate and the second power transmitting substrate and connected in series to the first groups, emit light by a supplied AC having a second voltage higher than the first voltage.

8. The lighting apparatus of claim 7, wherein the plurality of PN junction light-emitting elements positioned in the first light-emitting module and the second light-emitting module are packaged in light-emitting element packages, and the plurality of PN junction light-emitting elements positioned within each light-emitting element package are divided into a plurality of groups.

9. The lighting apparatus of claim 8, wherein the PN junction light-emitting elements of the first group of the first light-emitting module and the PN junction light-emitting elements of the first group of the second light-emitting module are connected in parallel, and the PN junction light-emitting elements of the second group of the first light-emitting module and the PN junction light-emitting elements of the second group of the second light-emitting module are connected in parallel.

10. The lighting apparatus of claim 1, wherein, an input lead line and output lead line are individually connected to each of the PN junction light-emitting elements of the light-emitting element package, and wherein, in the first group, one PN junction light-emitting element positioned within the first boundary and one PN junction light-emitting element positioned within the second boundary are connected in parallel, and, in the second group, another PN junction light-emitting element positioned within the first boundary and another PN junction light-emitting element positioned within the second boundary are connected in parallel, and wherein, the apparatus further comprises a second switch that is provided on the power transmitting substrate, and wherein the second switch goes into the ON state to cause the PN junction light-emitting elements of the second group to emit light when the first switch is in the OFF state by the supplied AC having the second voltage.

* * * * *